US006293190B1

(12) United States Patent
Yashima

(10) Patent No.: US 6,293,190 B1
(45) Date of Patent: Sep. 25, 2001

(54) STENCIL PRINTER

(75) Inventor: Michihiro Yashima, Shiroishi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/494,467

(22) Filed: Jan. 31, 2000

(30) Foreign Application Priority Data

May 18, 1999 (JP) ..... 11-136790

(51) Int. Cl.[7] ..... B41F 15/42; B41L 13/18
(52) U.S. Cl. ..... 101/120; 101/119
(58) Field of Search ..... 101/116, 119, 101/120, 129

(56) References Cited

U.S. PATENT DOCUMENTS

| | | | | |
|---|---|---|---|---|
| 3,796,153 | * | 3/1974 | Jaffa | 101/120 |
| 3,807,302 | * | 4/1974 | Kudlich | 101/119 |
| 3,919,973 | * | 11/1975 | Zimmer | 101/120 |
| 3,988,986 | * | 11/1976 | Zimmer | 101/119 |
| 4,436,032 | * | 3/1984 | Va Ouwerkerk | 101/120 |
| 5,151,132 | * | 9/1992 | Zimmer | 101/120 |
| 6,101,936 | * | 8/2000 | Claassen | 101/119 |

FOREIGN PATENT DOCUMENTS

| | | | | |
|---|---|---|---|---|
| 2638344 | * | 7/1977 | (DE) | 101/120 |
| 3-164287 | | 7/1991 | (JP) . | |
| 4-296585 | | 10/1992 | (JP) . | |
| 6-135114 | | 5/1994 | (JP) . | |
| 7-052518 | | 2/1995 | (JP) . | |
| 8-025781 | | 1/1996 | (JP) . | |
| 8-142474 | | 6/1996 | (JP) . | |
| 10-217595 | | 8/1998 | (JP) . | |

* cited by examiner

*Primary Examiner*—Stephen R. Funk
(74) *Attorney, Agent, or Firm*—Oblon, Spivak, McClelland, Maier & Neustadt, P.C.

(57) ABSTRACT

A stencil printer operable with a master wrapped around a print drum includes a rotatable print drum. An ink roller is rotatable in the same direction as the print drum for feeding ink to the inner periphery of the drum. An ink replenishing roller is rotatable in the same direction as the print drum and ink roller and movable between a first position where it is spaced from the inner periphery of the drum and ink roller and a second position where it contacts the inner periphery of the drum and ink roller. An ink collecting member is located downstream of the ink replenishing roller in the direction of rotation of the print drum and movable in interlocked relation to the ink replenishing roller. The printer is capable of surely removing excess ink from the inner periphery of the print drum and desirably forming even the first image after a long time of suspension. The ink collecting member is interlocked to the ink replenishing roller and has its edge initially spaced from the inner periphery of the print drum, so that friction between the ink collecting member and the inner periphery of the print drum is obviated. In addition, ink is prevented from being collected more than necessary. Consequently, there can be obviated noise and short image density.

14 Claims, 5 Drawing Sheets

STENCIL PRINTER

BACKGROUND OF THE INVENTION

The present invention relates to a stencil printer operable with a master wrapped around a print drum and more particularly to the structure and operation of an ink feeding mechanism included in a stencil printer.

Generally, a thermal digital stencil printer includes a rotatable print drum made up of a porous cylindrical support and a plurality of metallic mesh screens covering the support in a laminate. A stencil to be wrapped around the print drum as a master has a laminate structure consisting of a thermoplastic resin film which is usually 1 $\mu$m to 3 $\mu$m thick, and a porous substrate to which the resin film is adhered. The substrate is formed of fibers of Japanese paper or synthetic fibers or a mixture thereof. After a thermal head has selectively perforated, or cut, the film surface of the stencil, the resulting master is wrapped around the print drum. Subsequently, ink feeding means arranged within the print drum feeds ink to the inner periphery of the print drum. A press roller or similar pressing means presses a paper or similar recording medium against the print drum with the intermediary of the master. As a result, the ink is transferred to the paper via the porous portion of the drum and the perforations of the master, forming an image on the paper.

A problem with the above stencil printer is that if the ink exists in the print drum in an excessive amount, it leaks from the drum and brings about defective printing. Another problem is that when the printer is not used over a long period of time, the ink is degenerated due to the evaporation of water held in the cylindrical support and mesh screens of the print drum. As a result, when the printer is operated for the first time after such a long time of suspension, it is likely that images are blurred or otherwise effected and causes several to several tens of papers to be wasted.

To solve the above problems, Japanese Patent Laid-Open Publication No. 8-142474, for example, discloses ink collecting means disposed in the print drum and contacting the inner periphery of the drum for collecting excess ink existing in the drum. The ink collecting means, however, constantly contacts the inner periphery of the print drum and produces noise ascribable to friction between the former and the latter. This, coupled with the fact that the ink collecting means collects the ink more than necessary, lowers image density. In addition, the ink collecting means deteriorates rapidly.

Technologies relating to the present invention are also disclosed in, e.g., Japanese Patent Laid-Open Publication Nos. 3-164287, 4-296585, 6-135114, 7-52518, 8-25781, and 10-217595.

SUMMARY OF THE INVENTION

It is therefore an object of the present invention to provide a stencil printer capable of desirably producing even the first print after a long time of suspension without any noise or short image density.

A stencil printer of the present invention includes a rotatable print drum. An ink roller is rotatable in the same direction as the print drum for feeding ink to the inner periphery of the drum. An ink replenishing roller is rotatable in the same direction as the print drum and ink roller and movable between a first position where it is spaced from the inner periphery of the drum and ink roller and a second position where it contacts the inner periphery of the drum and ink roller. An ink collecting member is located downstream of the ink replenishing roller in the direction of rotation of the print drum and movable in interlocked relation to the ink replenishing roller.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
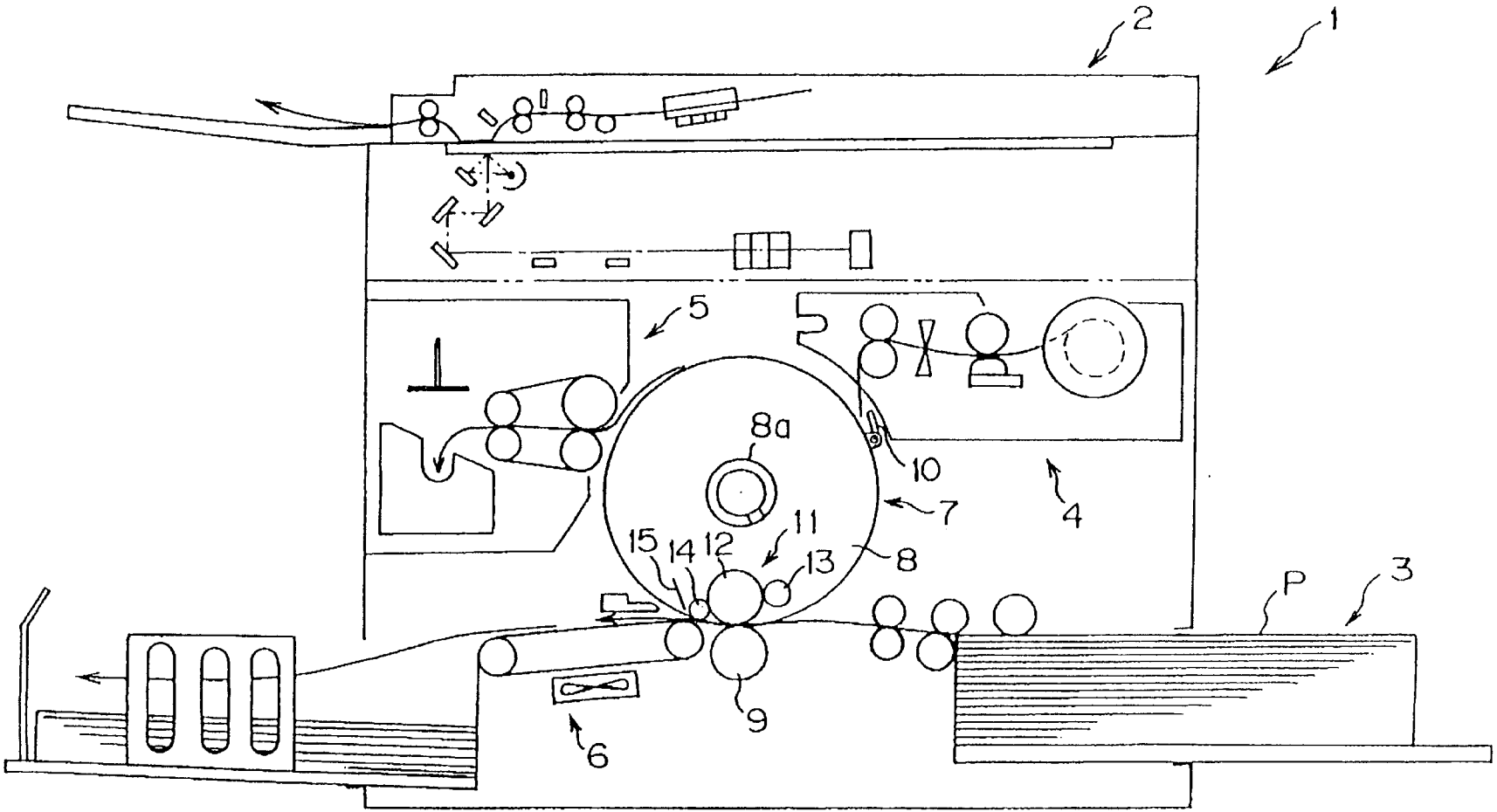
FIG. 1 is a front view showing a stencil printer embodying the present invention.

Referring to FIG. 1 of the drawings, a stencil printer embodying the present invention is shown and generally designated by the reference numeral 1. As shown, the printer 1 is generally made up of a document scanning section 2, a sheet feeding section 3, a master making section 4, a master discharging section 5, a sheet discharging section 6, and a printing section 7. The sections other than the printing section 7 are identical with conventional ones and will not be described specifically.

The printing section 7 includes a print drum 8 and a press roller 9. The print drum 8 is rotatably mounted on a shaft 8*a* and caused to rotate by a main motor 29 (see FIG. 6). A stage, not shown, and a damper 10 are mounted on the outer periphery of the print drum 8 while ink feeding means 11 is arranged within the print drum 8. Moving means, not shown, causes the press roller 9 to move into and out of contact with the outer periphery of the print drum 8. The press roller 9 presses a paper or similar recording medium P against the print drum 8 when brought into contact with the press drum 8, so that an image is transferred from the drum 8 to the paper P.

Figure 2:
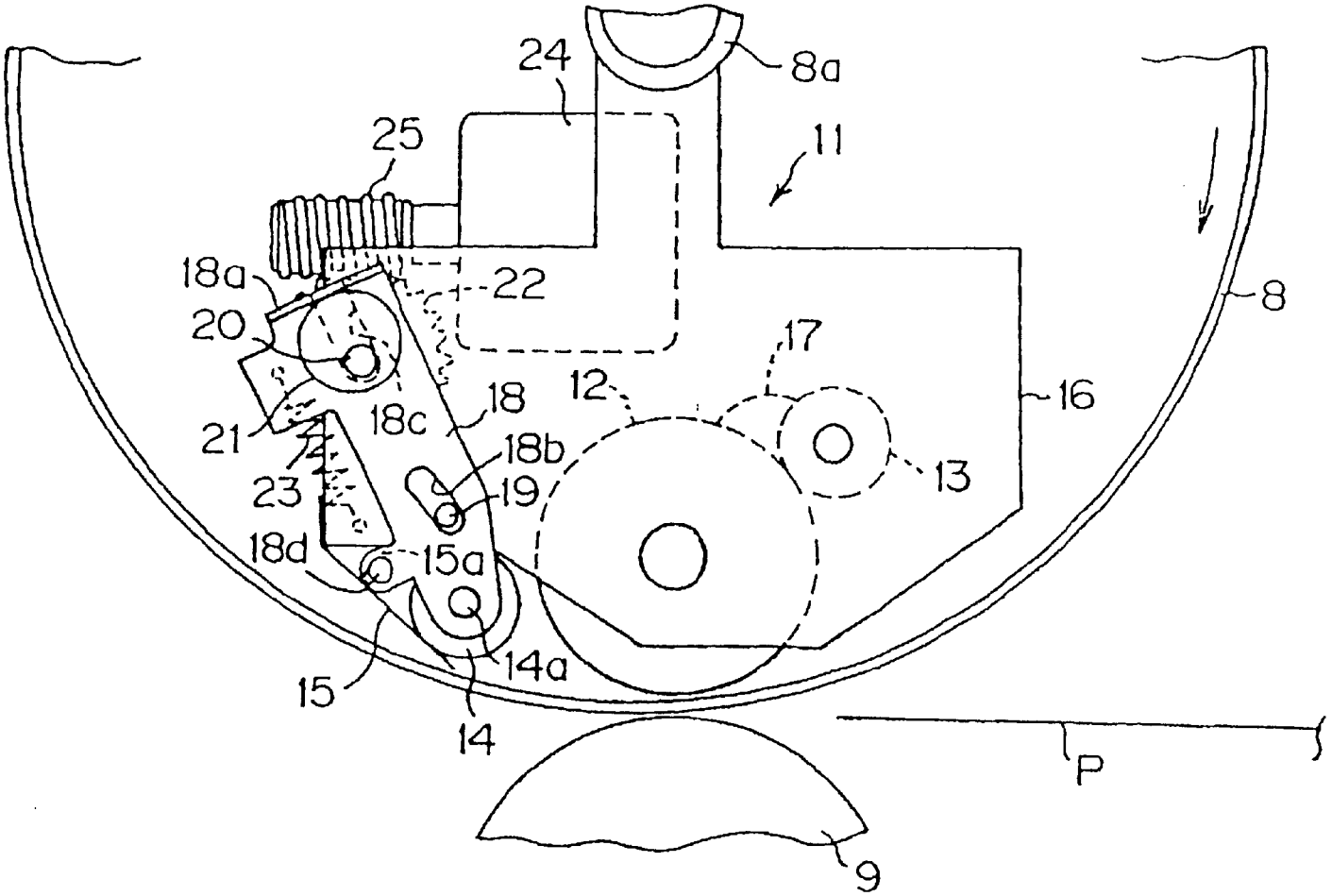
FIGS. 2 and 3 are fragmentary front views showing a print drum included in the illustrative embodiment.

FIG. 2 shows the print drum 8 in a fragmentary view. As shown, the ink feeding means 11 includes an ink roller 12, a doctor roller 13, an ink replenishing roller 14, and a blade or ink collecting member 15. The ink roller 12 is journal led to opposite side walls 16 affixed to the shaft 8*a* such that its outer periphery adjoins the inner periphery of the print drum 8. Ink fed from an ink feed pipe, not shown, is transferred to the inner periphery of the print drum 8 by the ink roller 12. The rotation of the main motor 29 is transmitted to the ink roller 12 via drive transmitting means, not shown, including gears and a belt, so that the ink roller 12 rotates clockwise, as viewed in FIG. 2, in synchronism with the print drum 8.

The doctor roller 13 is also journal led to the side walls 16 in the vicinity of the ink roller 12. The rotation of the main motor 29 is transmitted to the doctor roller 13 via drive transmitting means, not shown, causing the doctor roller 13 to rotate in the opposite direction to the ink roller 12. The outer periphery of the doctor roller 13 is spaced from the outer periphery of the ink roller 12 by a small gap, so that a wedge-like ink well 17 is formed between the outer periphery of the doctor roller 13 and that of the ink roller 12. The ink in the ink well 17 is passed through the gap between the ink roller 12 and the doctor roller 13 and forms an ink layer on the ink roller 12.

The ink replenishing roller 14 is positioned downstream of the ink roller 12 in the direction of rotation of the print drum 8. The ink replenishing roller 14 is mounted on a shaft 14*a* which is, in turn, journal led to a pair of flat arms 18 at its opposite ends.

Figure 4:
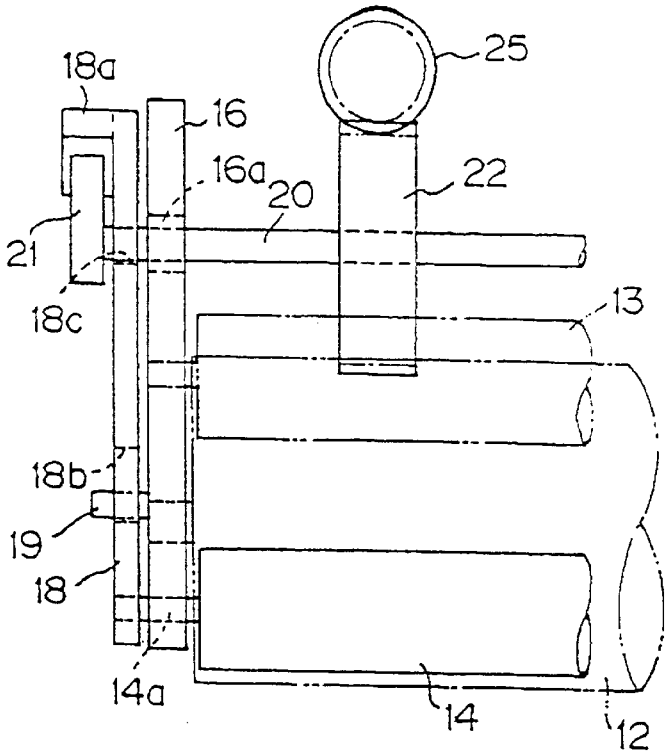
FIG. 4 is a fragmentary side elevation of the print drum.

The end of each arm 18 opposite to the end rotatably supporting the shaft 14*a* is bent to form a receiving portion 18*a*. A slot 18*b* is formed in substantially the intermediate portion of the arm 18 while a slot 18*c* is formed in the arm 18 in the vicinity of the receiving portion 18*a*. The arms 18 are positioned outside of the side walls 16. Specifically, a pin 19 is studded on the outer surface of each side wall 16 and received in the slot 18*b* of one arm 18 adjoining the side wall 16. A shaft 20 is journal led to the side walls 16 via bearings 16*a* (see FIG. 4 that is a view as seen from the right of FIG. 2) mounted on the side walls 16. The shaft 20 has its opposite ends received in the slots 18*c* of the arms 18. A tie rod 18*d* connects the end portions of the arms 18 adjoining the shaft 14*a* to each other.

Cam disks 21 are mounted on opposite ends of the shaft 20 while a worm wheel 22 is mounted on the center portion of the shaft 20. Each cam disk 21 is affixed to the shaft 20 at its position offset from the center such that the outer periphery of a larger diameter portion included in the cam disk 21 is capable of contacting the associated receiving portion 18*a*. A bracket, not shown, is provided on the inner surface of the end portion of each arm 18 adjoining the receiving portion 18*a*. Also, a bracket, not shown, is provided on the inner surface of each side wall 16. A tension spring 23 is anchored to the above brackets at its opposite ends and constantly biases the arm 18 in the direction in which the receiving portion 18*a* tends to contact the circumference of the cam disk 21.

A stepping motor 24 is affixed to the side walls 16 via mounting members, not shown, in the vicinity of the worm wheel 22. A worm 25 is mounted on the output shaft of the stepping motor 24 and held in mesh with the worm wheel 22.

Figure 3:
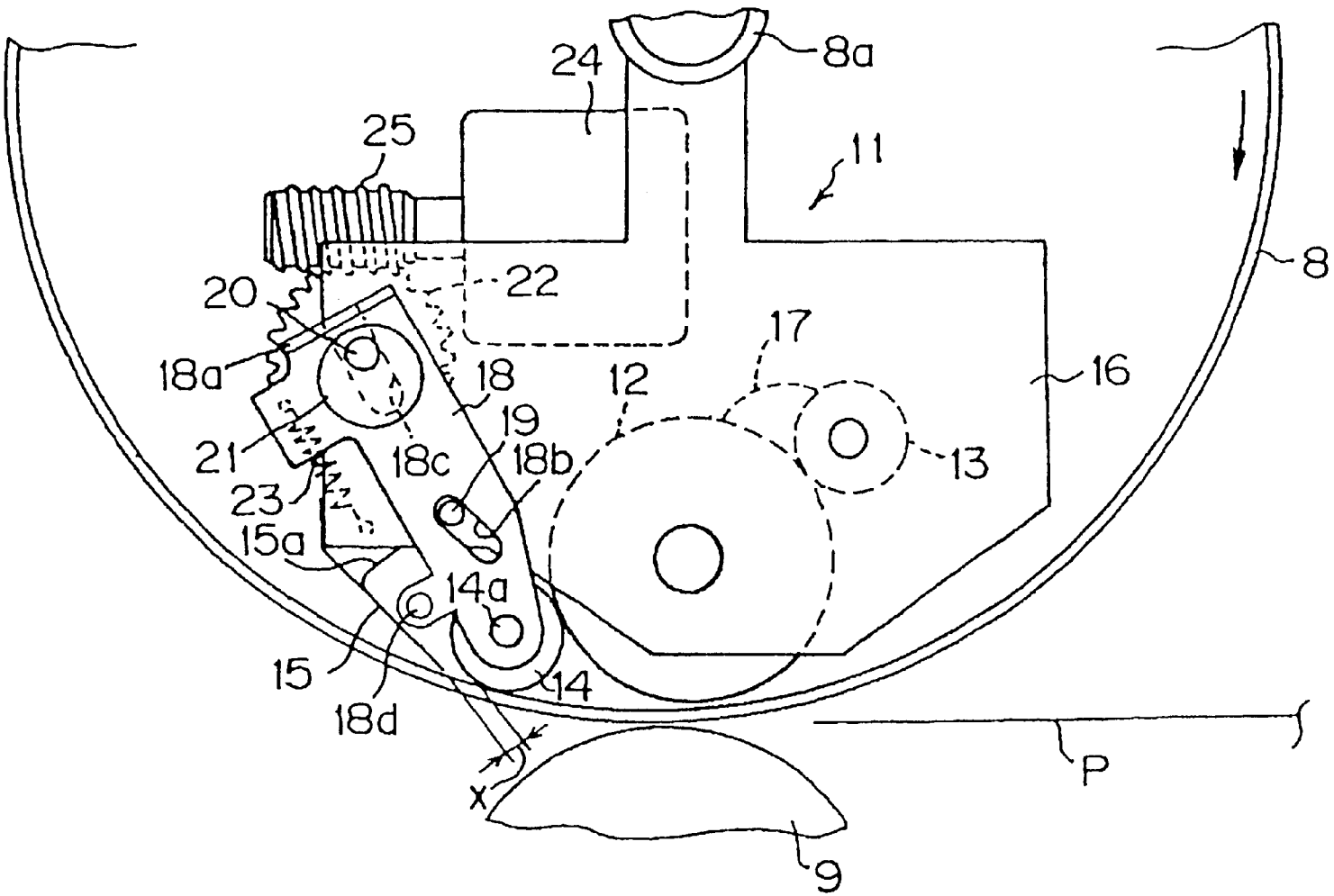

The blade or ink collecting member 15 is located downstream of the ink replenishing roller 14 in the direction of rotation of the print drum 8 and formed of spring steel, resin or similar elastic material. The blade 15 extends over substantially the entire axial width of the print drum 8. One end of the blade 15 is affixed to a bracket, not shown, extending between the side walls 16. The other end of the blade 15 is held in contact with the inner periphery of the print drum 8 with a preselected elastic force. The blade 15 has a plurality of bent portions 15*a* at its suitable intermediate position. Specifically, the bent portions 15*a* are positioned such that they contact the tie rod 18*d* when the ink replenishing roller 14 is moved from a second position shown in FIG. 3 to a first position shown in FIG. 2, as will be described specifically later.

The stepping motor 24 causes the cam disks 21 to rotate and thereby selectively moves the ink replenishing roller 14 and blade 15 to the first position or the second position. A controller 28 that will be described later with reference to FIG. 6 controls the operation of the stepping motor 24.

Specifically, when the larger diameter portions of the cam disks 21 contact the receiving portions 18*a* of the associated arms 18, the ink replenishing roller 14 is brought to the first position shown in FIG. 2. In the first position, the roller 14 is spaced from the inner periphery of the print drum 8 and the outer periphery of the ink roller 12 against the action of the tension springs 23. When the larger diameter portions of the cam disks 21 move away from the receiving portions 18*a*, the roller 14 is brought into contact with the inner periphery of the print drum 8 and the outer periphery of the ink roller 12 by the action of the tension springs 23. As soon as the smallest diameter portions of the cam disks 21 face the receiving portions 18*a*, the roller 14 reaches the second position of FIG. 3 in which it is pressed against the print drum 8 and ink roller 12 by the preselected bias of the tension springs 23. Each cam disk 21 has such a profile that when its smallest diameter portion faces the associated receiving portion 18*a*, a small gap exists between the former and the latter. Further, the bias of the tension springs 23 is selected such that the roller 14 exerts a greater contact force on the inner periphery of the print drum 8 than on the outer periphery of the ink roller 12 when brought to the second position.

When the larger diameter portions of the cam disks 21 contact the associated receiving portions 18*a*, the tie rod 18*d* raises the bent portions 15*a* of the blade 15. As a result, the blade 15 is brought to the first position shown in FIG. 2 with its edge contacting the outer periphery of the ink replenishing roller 14. When the larger diameter portions move away from the receiving portions 18*a*, the blade 15 is located in the second position shown in FIG. 3 due to its own elasticity. In the second position, the edge of the blade 15 contacts the inner periphery of the print drum 8. The blade 15 is positioned such that a small gap x exists between the edge of the blade 15 and the ink replenishing roller 14 in the second position. The elasticity of the blade 15 is selected such that when the ink replenishing roller 14 is brought to the second position, the blade 15 exerts a smaller contact force on the inner periphery of the print drum 8 than the roller 14.

Figure 5:
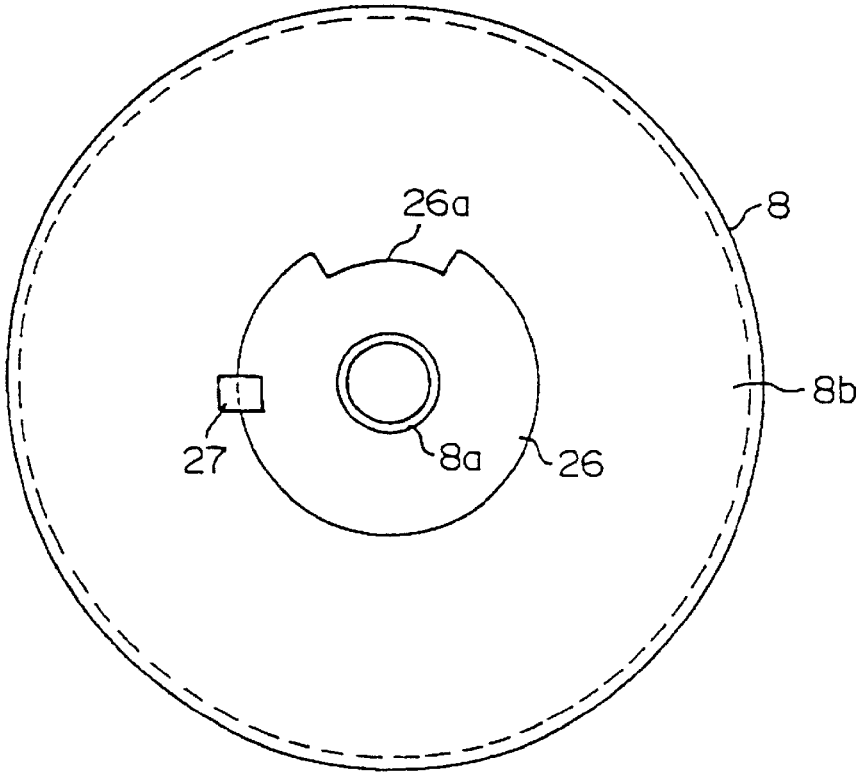
FIG. 5 is a view showing a sensor also included in the illustrative embodiment.

As shown in FIG. 5, a cam 26 is mounted on one of opposite flanges 8*b* of the print drum 8 and rotatable integrally with the print drum 8. The cam 26 has a notch 26*a* extending over an angular range corresponding to a nonporous portion included in each of a porous support and a mesh screen, not shown, which constitute the print drum 8. A sensor 27 is positioned in the vicinity of the cam 26. While the sensor 27 is sensing the cam 26, it continuously delivers an ON signal to the controller 28.

Figure 6:
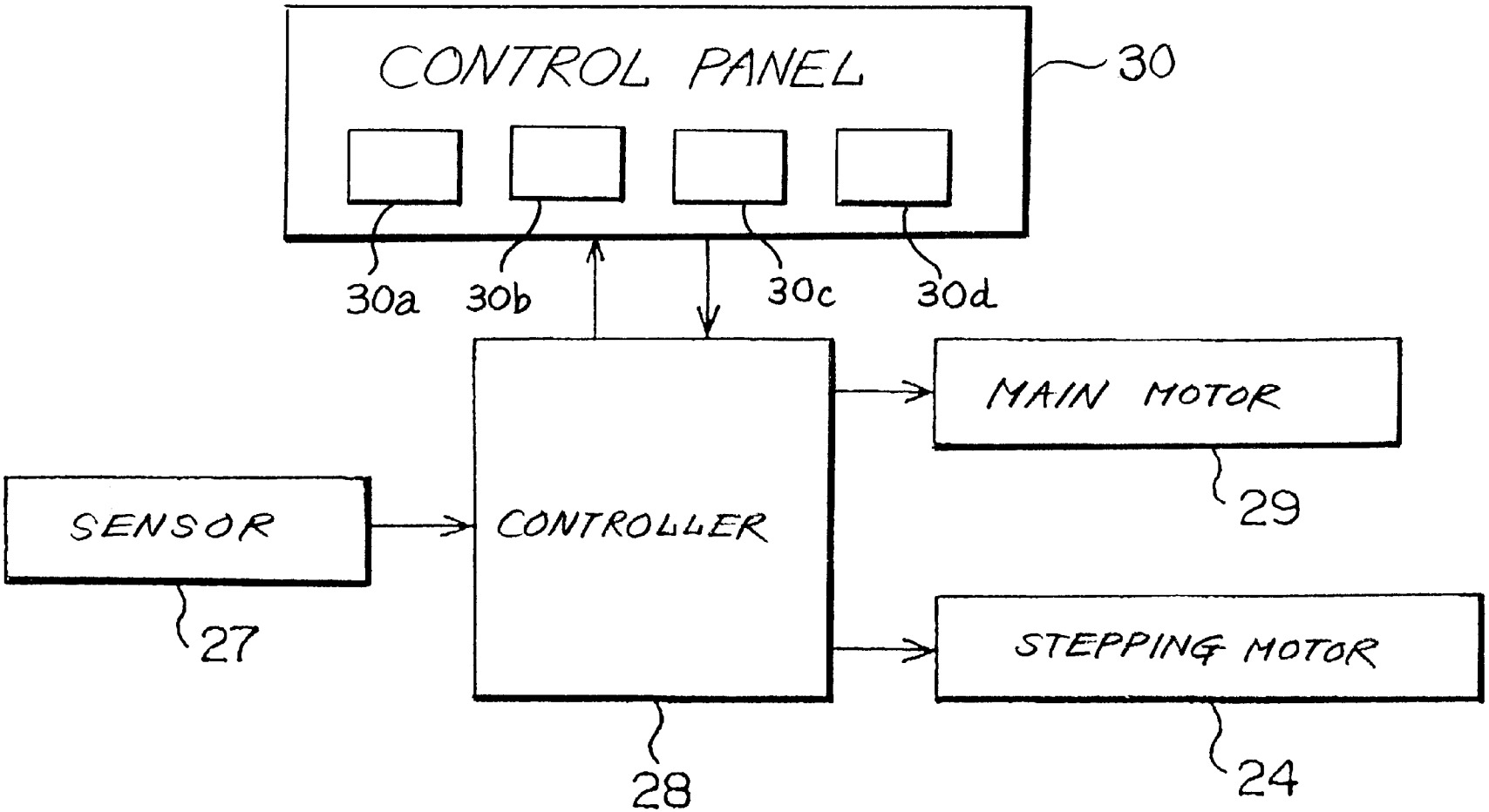
FIG. 6 is a block diagram schematically showing a control system further included in the illustrative embodiment.

Reference will be made to FIG. 6 for describing a control system including the controller 28. The controller 28 is implemented as a conventional microcomputer including a CPU (Central Processing Unit), a ROM (Read Only Memory) and a RAM (Random Access Memory). As shown, the controller 28 controls the operation of the stepping motor 24 and that of the main motor 29 in response to an operation command input via a control panel 30. The control panel 30 includes two keys 30*a* and 30*b* respectively used to select an ink collection mode and to set a desired number of times of ink collection. When the ink collection mode is selected on the key 30*a*, the controller 28 locates the ink replenishing roller 14 and blade 15 at the second position, FIG. 3, after the end of printing. At the same time, the controller 28 validates a number of ON signals to be output from the sensor 27 corresponding to the number of times of ink collection selected on the key 30*b* and causes the main motor 29 to start rotating the print drum 8. Every time the ON signal from the sensor 27 disappears, the controller 28 decrements the above number of times by 1 (one). When the number of times reaches zero, the controller 28 stops the rotation of the print drum 8 and returns the ink replenishing roller 14 and blade 15 to the first position, FIG. 2.

In operation, when the operator selects the ink collection mode on the key 30*a* and sets a desired number of times of ink collection on the key 30*b*, the controller 28 causes the stepping motor 24 to rotate after the end of printing, thereby locating the replenishing roller 14 and blade 15 at the second position.

Subsequently, the controller 28 causes the main motor 29 to rotate the print drum 8 clockwise as viewed in FIG. 1. The ink roller 12 and doctor roller 13 are rotated together with the print drum 8. At the same time, the ink replenishing roller 14 is caused to rotate. Because the ink replenishing roller 14 exerts a greater contact force on the inner periphery of the print drum 8 than on the outer periphery of the ink roller 12, as stated earlier, the roller 14 is rotated clockwise by the print drum 8.

While the print drum 8 is in rotation, the blade 15 scrapes off excess ink from the inner periphery of the print drum 8 with its edge. The ink scraped off by the blade 15 and transferred to the blade 15 is stored in the gap x. The stored ink is transferred to the ink replenishing roller 14 rotating clockwise and then transferred to the ink roller 12. As a result, the ink is collected in the ink well 17 which is the regular ink storage. At this instant, because the blade 15 is located as close to the ink roller 12 feeding ink as possible, the excess ink exists on the inner periphery of the print drum 8 only between the ink roller 12 and the blade 15. It is therefore possible to collect most of the ink existing on the print drum 8.

When the notch 26*a* of the cam 26 rotating integrally with the print drum 8 meets the sensor 27, the sensor 27 stops outputting the ON signal. In response, the controller 28 decrements the number of times of ink collection set on the control panel 30 by 1. When the ink collection is repeated the set number of times, the controller 28 stops driving the main motor 29 and thereby stops the print drum 8 at a preselected home position. At the same time, the controller 28 drives the stepping motor 24 in order to return the ink replenishing roller 14 and blade 15 to the first position. As a result, the printer 1 is restored to its initial conditions.

With the above construction and operation, it is possible to surely remove excess ink from the inner periphery of the print drum 8. Because the number of times of ink collection can be freely selected in accordance with the property of the ink including viscosity, the ink can be collected in an optimal way matching with the kind of the ink. It follows that even the first image formed after a long time of suspension is attractive.

The blade 15 is movable in interlocked relation to the ink replenishing roller 14 and has its edge initially spaced from the inner periphery of the print drum 8. This obviates friction between the blade 15 and the inner periphery of the print drum 8 and prevents the ink from being collected more than necessary. Consequently, there can be obviated noise and short image density.

The blade 15 exerts a smaller contact force on the inner periphery of the print drum 8 than the ink replenishing roller 14. Therefore, when the ink replenishing roller 14 feeds ink to the inner periphery of the drum 8, the blade 15 is successfully prevented from collecting the ink adequately replenished by the roller 14.

In the above embodiment, the printer 1 executes, after the end of printing, ink collection a desired number of times input on the key 30*b*. Alternatively, the printer 1 may be constructed to automatically bring the ink replenishing roller 14 and blade 15 to the second position for collecting the ink when the print drum 8 makes the last rotation at the end of printing. Although such automatic ink collection collects the ink only once, it can be executed during printing and therefore allows even the first image to be desirably formed after a long time of suspension while reducing the operation time.

If desired, the control panel 30 may additionally include a key 30*c* for causing a plurality of printing operations to be continuously executed. When the operator presses the key 30*c*, the printer 1 will perform ink collection only at the end of the last printing operation. This successfully omits ink collection otherwise effected at the end of each printing operation and again allows even the first image to be desirably formed after a long time of suspension while noticeably reducing the operation time. Ink collection can be executed during printing in the same manner as in the previous construction.

Further, the control panel 30 may include another key 30*d* for allowing ink collection to be executed at any desired timing. Specifically, when a plurality of printing operations are to be continuously executed, the key 30*d* allows the operator to input a desired ink collection timing between the printing operations. This allows even the first image to be efficiently formed after a long time of suspension. In this case, ink replenishment and ink collection may, of course, be executed before the start of printing.

In the illustrative embodiment and above modifications thereof, the ink replenishing roller 14 is pressed against the ink roller 12 and the inner periphery of the print drum 8 by a preselected bias and rotated thereby. If desired, the replenishing roller may be driven by exclusive drive means.

In summary, it will be seen that the present invention provides a stencil printer having various unprecedented advantages, as enumerated below.

(1) It is possible to surely remove excess ink from the inner periphery of a print drum and to desirably form even the first image after a long time of suspension. An ink collecting member is movable in interlocked relation to an ink replenishing roller and has its edge initially spaced from the inner periphery of the print drum. This obviates friction between the ink collecting member and the inner periphery of the print drum and prevents ink from being collected more than necessary. Consequently, there can be obviated noise and short image density.

(2) The ink collecting member exerts a smaller contact force on the inner periphery of the print drum than the ink replenishing roller. Therefore, when the ink replenishing roller feeds ink to the inner periphery of the print drum, the ink collecting member is successfully prevented from collecting ink adequately replenished by the replenishing roller.

(3) Ink collection can be executed during printing and therefore allows even the first image to be desirably formed after a long time of suspension while reducing the operation time.

(4) Ink collection can be executed at any desired timing during printing. This allows even the first image to be efficiently formed after a long time of suspension.

(5) There can be omitted ink collection otherwise effected at the end of each printing operation. This also allows even the first image to be desirably formed after a long time of suspension while noticeably reducing the operation time.

(6) Because ink collection is effected only at the end of the last printing operation, there can be omitted ink collection otherwise effected at the end of each printing operation preceding it. This also allows even the first image to be desirably formed after a long time of suspension while noticeably reducing the operation time.

(7) Because the number of times of ink collection can be freely selected in accordance with the property of ink including viscosity, the ink can be collected in an optimal way matching with the kind of the ink. It follows that even the first image formed after a long time of suspension is attractive.

Various modifications will become possible for those skilled in the art after receiving the teachings of the present disclosure without departing from the scope thereof.

What is claimed is:

1. A stencil printer comprising:

a rotatable print drum;

an ink roller configured to be rotated in a same direction as said print drum and to feed ink directly to an inner periphery of said print drum during printing;

an ink replenishing roller configured to be rotated in a same direction as said print drum and said ink roller and to be moved between a first position where said ink replenishing roller is spaced from the inner periphery of said print drum and said ink roller and a second position where said ink replenishing roller contacts said inner periphery of said print drum and said ink roller; and an ink collecting member located downstream of said ink replenishing roller in a direction of rotation of said print drum and configured to move in inter locked relation to said ink replenishing roller between said first position and said second position.

2. The stencil printer as claimed in claim 1, wherein said ink collecting member is configured to contact the inner periphery of said print drum when said ink replenishing roller is brought to said second position.

3. The stencil printer as claimed in claim 2, wherein said ink collecting member is configured to exert a smaller contact force on the inner periphery of said print drum than said ink replenishing roller.

4. The stencil printer as claimed in claim 2, wherein said ink replenishing roller is configured to gather ink from the inner periphery of said print drum collected by said collecting member in contact with said inner periphery of said print drum.

5. The stencil printer as claimed in claim 1, wherein said ink collecting member comprises a flat elastic member.

6. The stencil printer as claimed in claim 1, further comprising control means for causing said ink replenishing roller and said ink collecting member to move to said second position when said print drum makes a last rotation during printing.

7. The stencil printer as claimed in claim 6, wherein when a printing operation is repeatedly executed, said control means causes said ink replenishing roller and said ink collecting member to move to said second position only at an end of a last printing operation.

8. The stencil printer as claimed in claim 1, further comprising control means for causing, after a printing operation, said ink replenishing roller and said ink collecting member to move to said second position and causing said print drum to rotate.

9. The stencil printer as claimed in claim 8, wherein when a printing operation is repeatedly executed, said control means causes said ink replenishing roller and said ink collecting member to move to said second position only after a last printing operation.

10. The stencil printer as claimed in claim 8, wherein when said ink replenishing roller and said ink collecting member are brought to said second position, said print drum makes a desired number of rotations set by an operator.

11. The stencil printer as claimed in claim 1, further comprising control means for causing, at a desired timing set by an operator, said ink replenishing roller and said ink collecting member to move to said second position and causing said print drum to rotate.

12. A stencil printer as claimed in claim 1, wherein when said ink replenishing roller and said ink collecting member are brought to said second position, said control means causes said print drum to make a desired number of rotations set by an operator.

13. The stencil printer as claimed in claim 1, wherein said ink replenishing roller is configured to gather ink from the inner periphery of said print drum.

14. The stencil printer as claimed in claim 1, wherein a gap is formed between the ink collecting member and the ink replenishing roller.

* * * * *